US010047953B2

(12) United States Patent
Sato et al.

(10) Patent No.: US 10,047,953 B2
(45) Date of Patent: Aug. 14, 2018

(54) GASIFICATION MELTING FACILITY

(75) Inventors: Jun Sato, Tokyo (JP); Toshimasa Shirai, Yokohama (JP); Yoshihisa Saito, Yokohama (JP); Norio Yoshimitsu, Yokohama (JP); Yasunori Terabe, Yokohama (JP)

(73) Assignee: MITSUBISHI HEAVY INDUSTRIES ENVIRONMENTAL & CHEMICAL ENGINEERING CO., LTD., Kanagawa (JP)

( * ) Notice: Subject to any disclaimer, the term of this patent is extended or adjusted under 35 U.S.C. 154(b) by 1084 days.

(21) Appl. No.: 14/000,315

(22) PCT Filed: Apr. 5, 2011

(86) PCT No.: PCT/JP2011/058628
§ 371 (c)(1),
(2), (4) Date: Aug. 19, 2013

(87) PCT Pub. No.: WO2012/137307
PCT Pub. Date: Oct. 11, 2012

(65) Prior Publication Data

US 2013/0319300 A1 Dec. 5, 2013

(51) Int. Cl.
*F23G 5/027* (2006.01)
*F23G 5/033* (2006.01)
(Continued)

(52) U.S. Cl.
CPC ..... *F23G 5/027* (2013.01); *F23G 5/033* (2013.01); *F23G 5/30* (2013.01); *F23G 5/32* (2013.01);
(Continued)

(58) Field of Classification Search
CPC ..... F23C 2206/101; F23C 2900/01001; F23K 1/00; F23K 3/00; F23K 1/04; F23K 2201/30; F23K 2201/50; F23K 2201/505
(Continued)

(56) References Cited

U.S. PATENT DOCUMENTS 2,869,519 A * 1/1959 Schroedter ..... F23C 3/008 122/478
5,584,255 A 12/1996 Bishop et al.
(Continued)

FOREIGN PATENT DOCUMENTS

EP 0 778 446 B1 10/2002
JP 9-236223 A 9/1997
(Continued)

OTHER PUBLICATIONS

Extended European Search Report dated Mar. 5, 2015, issued in corresponding European Patent Application No. 11863205.8 (6 pages).
(Continued)

*Primary Examiner* — David J Laux
(74) *Attorney, Agent, or Firm* — Westerman, Hattori, Daniels & Adrian, LLP

(57) ABSTRACT

This gasification melting facility includes: a fluidized bed gasification furnace that generates pyrolysis gas by thermally decomposing waste and discharges incombustibles; a vertical cyclone melting furnace that includes a pyrolysis gas duct through which the pyrolysis gas is introduced; a pyrolysis gas passage that connects the fluidized bed gasification furnace with the pyrolysis gas duct of the vertical cyclone melting furnace; pulverizer that pulverize the incombustibles into pulverized incombustibles so that the particle size of the incombustibles becomes fine; and airflow transporter that puts the pulverized incombustibles in the
(Continued)

pyrolysis gas passage, and separating metal contained in the pulverized incombustibles by a difference in specific gravity while conveying the pulverized incombustibles together with airflow. The pyrolysis gas and the pulverized incombustibles are melted in the vertical cyclone melting furnace.

4 Claims, 3 Drawing Sheets

(51) Int. Cl.
*F23G 5/32* (2006.01)
*F23G 5/30* (2006.01)

(52) U.S. Cl.
CPC .. *F23G 2201/303* (2013.01); *F23G 2201/304* (2013.01); *F23G 2201/40* (2013.01); *F23G 2202/20* (2013.01); *F23J 2900/01001* (2013.01)

(58) Field of Classification Search
USPC ..... 110/104 R, 101 R, 106, 165 R, 229, 233, 110/245, 255, 259
See application file for complete search history.

(56) References Cited

U.S. PATENT DOCUMENTS

| | | | | |
|---|---|---|---|---|
| 5,862,762 | A | 1/1999 | Sekiguchi et al. | |
| 8,393,558 | B2 * | 3/2013 | Gitschel | B03B 9/06 241/19 |

FOREIGN PATENT DOCUMENTS

| | | | | |
|---|---|---|---|---|
| JP | 11-173521 | A | 6/1999 | |
| JP | WO 2004092649 | A1 * | 10/2004 | F23G 5/006 |
| JP | 2005-195228 | A | 7/2005 | |
| JP | 2006-194511 | A | 7/2006 | |
| JP | 2007-218458 | A | 8/2007 | |
| JP | 2008-69984 | A | 3/2008 | |
| JP | 4548785 | B2 | 9/2010 | |
| JP | 2010-230270 | A | 10/2010 | |
| WO | 2004/092649 | A | 10/2004 | |

OTHER PUBLICATIONS

International Search Report of PCT/JP2011/058628, dated May 24, 2011 with English translation (4 pages).
Written Opinion dated May 24, 2011, issued in corresponding International Application No. PCT/JP2011/058628 with English translation (6 pages).

* cited by examiner

GASIFICATION MELTING FACILITY

TECHNICAL FIELD

The present invention relates to a gasification melting facility that gasifies and melts waste.

BACKGROUND ART

In the past, a gasification and ash melting system has been known as a technique that can widely treat waste, such as incombustible waste, burned residue, and sludge in addition to municipal waste. The gasification and ash melting system includes: a gasification furnace that gasifies waste by thermally decomposing the waste; a melting furnace that is provided on the downstream side of the gasification furnace, combusts pyrolysis gas generated by the gasification furnace at high temperature, and converts ashes contained in the gas into molten slag; and a secondary combustion chamber that combusts flue gas discharged from the melting furnace. For the purpose of the recycling, volume reduction, and detoxification of waste, the gasification and ash melting system extracts slag from the melting furnace to reuse the slag as materials of construction such as base course materials or recovers waste heat from flue gas discharged from the secondary combustion chamber to generate electricity.

A fluidized bed gasification furnace is widely used as the gasification furnace of such a gasification and ash melting system. A fluidized bed, in which a fluid medium is fluidized by the supply of combustion air, is formed at the bottom of the fluidized bed gasification furnace, and the fluidized bed gasification furnace is a device that partially combusts the waste put in the fluidized bed and thermally decomposes the waste in the fluidized bed maintained at high temperature by the combustion heat.

Further, the fluidized bed gasification furnace is configured to discharge incombustibles from the bottom of the gasification furnace together with sand that is a fluid medium. Since the gasification melting facility requires volume reduction as described above, it is important to reduce the volume of incombustibles to be ultimately buried and treated. Means for reducing the volume of incombustibles, which are to be finally buried and treated, by recovering valuable metal, such as iron or aluminum, from incombustibles, and the like are known as means for reducing the volume of incombustibles.

A gasification melting facility that pulverizes incombustibles from which valuable metal has been removed and introduces the pulverized incombustibles into a melting furnace to melt the pulverized incombustibles is disclosed in Patent Document 1 as means for reducing the volume of other wastes. This gasification melting facility can introduce the incombustibles into the melting furnace by pulverizing the incombustibles after further removing metals (metals other than valuable metal) from the incombustibles, from which valuable metal has been removed, using a vibrating screen and by cutting out a fixed amount of the pulverized incombustibles.

PRIOR ART DOCUMENT

Patent Document

Patent Document 1: Japanese Unexamined Patent Application, First Publication No. 2008-69984

SUMMARY OF INVENTION

Problem to be Solved by the Invention

However, in the gasification melting facility disclosed in Patent Document 1, a vibrating screen that removes metals from incombustibles is needed in a process for treating the incombustibles. For this reason, there has been a problem in that the size of the gasification melting facility is increased. Further, since metals are insufficiently removed by the vibrating screen, there has been a problem in that metals are accidentally introduced into the melting furnace.

The invention has been made in consideration of these circumstances and an object of the present invention is to provide a gasification melting facility that can be constructed at lower cost by the reduction of the number of devices forming the facility and can reliably remove metals.

Means for Solving the Problem

In order to achieve the above-mentioned object, the present invention employs the following means.

That is, a gasification melting facility according to the present invention includes: a fluidized bed gasification furnace that generates pyrolysis gas by thermally decomposing waste and discharges incombustibles; a vertical cyclone melting furnace that includes a pyrolysis gas duct through which the pyrolysis gas is introduced; a pyrolysis gas passage that connects the fluidized bed gasification furnace with the pyrolysis gas duct of the vertical cyclone melting furnace; pulverizer that pulverize the incombustibles, which are discharged from the fluidized bed gasification furnace, into pulverized incombustibles so that the particle size of the incombustibles becomes fine; and airflow transporter that conveys the pulverized incombustibles, which are generated by the pulverizer, together with airflow, puts the pulverized incombustibles in the pyrolysis gas passage, and separates metal contained in the pulverized incombustibles by a difference in specific gravity while conveying the pulverized incombustibles together with airflow. The pyrolysis gas and the pulverized incombustibles are melted in the vertical cyclone melting furnace.

According to the gasification melting facility of the present invention, the pulverized incombustibles are conveyed together with airflow and metals contained in the pulverized incombustibles are separated while being conveyed together with airflow. Accordingly, a device that removes metal does not need to be provided, and therefore, it is possible to construct a gasification melting facility at lower cost.

It is preferable that the particle size of the pulverized incombustibles be adjusted to a fine particle size smaller than 0.1 mm.

According to the present invention, it is possible to reliably convey the pulverized incombustibles together with airflow and reliably remove metal.

Further, the gasification melting facility according to the present invention preferably further includes, on a front stage of the pulverizer, classifier that classifies the incombustibles and a fluid medium that is discharged from the fluidized bed gasification furnace, separator that separates iron and aluminum from the incombustibles that are classified by the classifier, and fixed amount feeder that feeds the incombustibles, which have been subjected to the separation performed by the separator, to the pulverizer by a fixed amount.

According to the present invention, it is possible to separate valuable metal from the incombustibles and to adjust the amount of the incombustibles to be fed to the pulverizer.

Furthermore, it is preferable that the pyrolysis gas duct be provided with a premix burner.

According to the present invention, since the pyrolysis gas and the pulverized incombustibles pass through the premix burner and are fed to the vertical cyclone melting furnace, it is possible to sufficiently preheat the pyrolysis gas and the pulverized incombustibles. Accordingly, smooth melting can be performed.

Moreover, it is preferable that the gasification melting facility according to the present invention include a plurality of the pyrolysis gas passages and a plurality of the pyrolysis gas ducts. The pyrolysis gas and the pulverized incombustibles are blown into the vertical cyclone melting furnace to cause a swirling flow.

According to the present invention, since the pyrolysis gas is introduced from the plurality of pyrolysis gas ducts, a swirling force of a gas flow in the vertical cyclone melting furnace can be increased and it is possible to prevent the pulverized incombustibles from carrying over in the flue gas without being caught in the vertical cyclone melting furnace.

Further, the airflow transporter preferably includes a pneumatic transport pipe that is curved toward the downstream side, a blower that generates airflow in the pneumatic transport pipe, and a metal removal pipe that extends downward from a curved portion of the pneumatic transport pipe.

According to the present invention, it is possible to remove metal by a simpler structure and to make the gasification melting facility compact.

Effect of the Invention

According to the present invention, the pulverized incombustibles are conveyed together with airflow and metals contained in the pulverized incombustibles are separated while being conveyed together with airflow. Accordingly, a device that removes metal does not need to be provided, and therefore, it is possible to construct a gasification melting facility at lower cost.

DESCRIPTION OF EMBODIMENTS

An embodiment of the present invention will be described below with reference to the drawings. An embodiment of the present invention will be described below with reference to the drawings.

Figure 1:
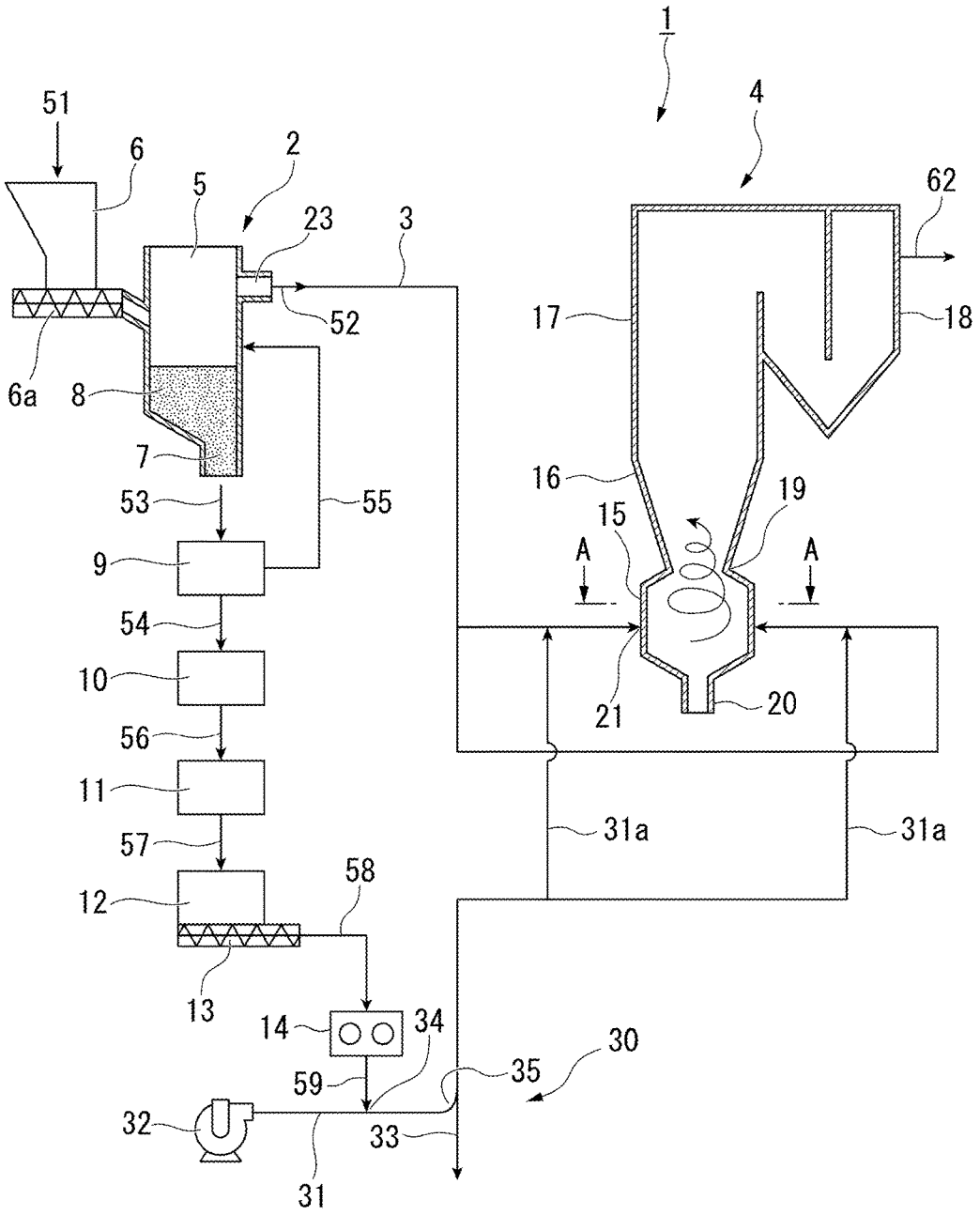
FIG. 1 is a view showing the structure of a gasification melting facility of an embodiment of the present invention.

As shown in FIG. 1, a gasification melting facility 1 of this embodiment includes a fluidized bed gasification furnace 2 and a melting apparatus 4. The gasification melting facility 1 introduces pyrolysis gas 52, which is generated by the thermal decomposition of waste 51 in the fluidized bed gasification furnace 2, to the melting apparatus 4 through a pyrolysis gas passage 3.

The fluidized bed gasification furnace 2 includes a gasification furnace body 5 having a rectangular cylindrical shape, and a waste inlet 6 including a waste discharge device **6*a* is provided on one side wall of the gasification furnace body 5. Further, a pyrolysis gas outlet 23 through which the pyrolysis gas generated in the gasification furnace is discharged is provided at the top portion of the gasification furnace body 5, and an incombustible outlet 7 is provided at the lower portion of the gasification furnace body 5. Furthermore, a fluid medium 8 (mainly, silica sand) is circulated and supplied to the bottom portion of the fluidized bed gasification furnace 2**.

Incombustibles and a fluid medium 53, which are discharged from the incombustible outlet 7, are fed to a sand classifier 9, and are separated into incombustibles 54 and a fluid medium 55. The fluid medium 55, which is separated here, is returned to the fluidized bed gasification furnace 2 by means such as a sand circulating elevator.

The incombustibles 54, which are discharged from the sand classifier 9, are fed to a separation device (separator) that includes a magnetic separator 10 and an aluminum sorter 11. First, the incombustibles 54 are fed to the magnetic separator 10, and iron is then separated. Next, incombustibles 56, which are discharged from the magnetic separator 10, are fed to the aluminum sorter 11, and aluminum is separated. Accordingly, valuable metal including iron and aluminum is separated.

Incombustibles 57, which are discharged from the aluminum sorter 11, are fed to a fixed amount feeding device 13 that includes a hopper 12. A fixed amount of the incombustibles 57, which are stored in the hopper 12, is cut out in the fixed amount feeding device 13. The cut incombustibles 58 are fed to a powdering machine 14 and are pulverized to have a particle size of 0.1 mm or less, so that the particle size of the incombustibles 58 is adjusted. Hereinafter, the incombustibles, which have been pulverized, are referred to as pulverized incombustibles 59. Since the particle size of the incombustibles 58 is adjusted to 0.1 mm or less, the incombustibles 58 are appropriately scattered by airflow when the pulverized incombustibles 59 are introduced into a pneumatic transport pipe 31 of an airflow conveyor 30 to be described below.

The airflow conveyor 30 is provided below the powdering machine 14. The airflow conveyor 30 includes a pneumatic transport pipe 31 on which a curved portion 35 is formed, a blower 32 that generates airflow in the pneumatic transport pipe 31, and a metal removal pipe 33 that is provided on the curved portion 35. The blower 32 is installed so as to generate airflow toward the downstream side from an upstream end of the pneumatic transport pipe 31.

Figure 2:
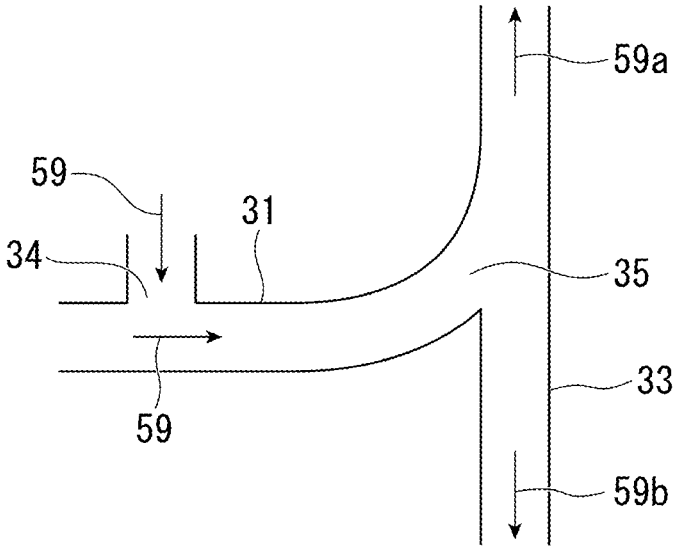
FIG. 2 is a schematic view of a pneumatic transport pipe of the embodiment of the present invention.

As shown in FIG. 2, an introduction portion 34 and the curved portion 35 are formed on the pneumatic transport pipe 31 in this order from the upstream side. Since the introduction portion 34 is connected to an outlet of the powdering machine 14, the pulverized incombustibles 59 having been pulverized by the powdering machine 14 are introduced into the pneumatic transport pipe 31 from the introduction portion 34. The pneumatic transport pipe 31 is curved on the downstream side of the introduction portion 34, so that the curved portion 35 is formed. The pneumatic transport pipe 31 is curved upward at the curved portion 35. Further, the metal removal pipe 33 extends downward from the curved portion 35.

The pneumatic transport pipe 31 is branched into two pipes on the downstream side of the curved portion 35. The pneumatic transport pipe 31, which is branched into two pneumatic transport pipes, is connected to branched pyrolysis gas passage 3 to be described below.

Next, the detail of the melting apparatus 4 will be described.

The melting apparatus 4 includes a vertical cyclone melting furnace 15, a secondary combustion chamber 17 that is connected to an upper portion of the vertical cyclone melting furnace 15 through a connecting portion 16, and a boiler portion 18 that is connected to a downstream portion of the secondary combustion chamber 17.

The vertical cyclone melting furnace 15 has a circular cross-section, and a flue gas outlet 19 having a throttling structure is formed at the upper portion of the vertical cyclone melting furnace 15. In other words, the diameter of the vertical cyclone melting furnace 15 is reduced once at the flue gas outlet 19, and the vertical cyclone melting furnace 15 extends upward in a conical shape so as to be widened and is connected to the secondary combustion chamber 17. Further, a slag outlet 20 is provided at the lower portion of the vertical cyclone melting furnace 15.

Figure 3:
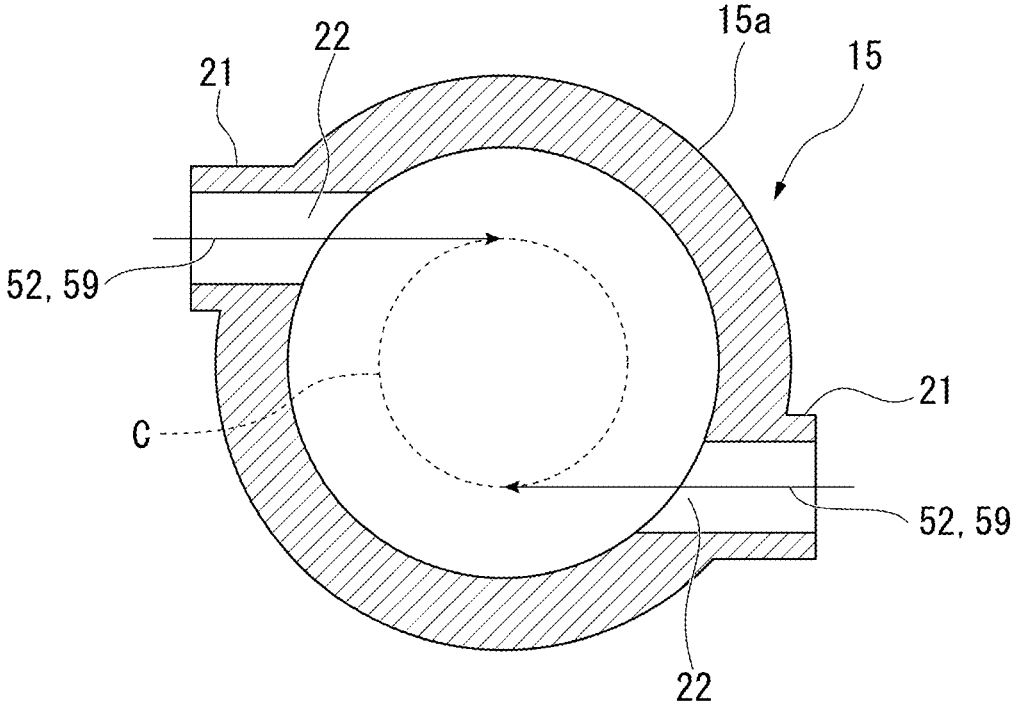
FIG. 3 is a cross-sectional view taken along line A-A of FIG. 1.

As shown in FIG. 3, the vertical cyclone melting furnace 15 includes a substantially cylindrical furnace wall 15*a* and a pair of pyrolysis gas ducts 21 through which the pyrolysis gas 52 is introduced are horizontally provided on the cross-section of the furnace wall 15*a* at predetermined positions in the up and down direction. The pyrolysis gas ducts 21 are disposed so that the pyrolysis gas 52 introduced from the pyrolysis gas ducts 21 is ejected in the tangential direction of a circle C formed in the vertical cyclone melting furnace. Furthermore, premix burners 22 are installed at portions of the pyrolysis gas ducts 21 that are connected to the vertical cyclone melting furnace 15.

Combustion air is blown into the premix burners 22 from nozzle holes that are formed on the circumferential surfaces of the premix burners 22. Air, oxygen, oxygen-enriched air, or the like may be used as the combustion air. In this case, an air ratio of the combustion air may be in the range of 0.9 to 1.1, and preferably about 1.0. It is possible to stably maintain the temperature in the furnace high by setting the air ratio as described above.

Since the pyrolysis gas 52 and the combustion air are blown into the vertical cyclone melting furnace 15 after being mixed with each other in the premix burners 22 in advance in this way, the pyrolysis gas 52 and the combustion air are sufficiently mixed with each other. Accordingly, it is possible to instantly combust the pyrolysis gas 52 in the furnace.

The secondary combustion chamber 17 is formed to have a square cross-section. The connecting portion 16 of which the diameter is reduced toward the flue gas outlet 19 of the vertical cyclone melting furnace 15 is provided at the lower end portion of the secondary combustion chamber 17. Since the boiler portion 18 is provided on the flue gas-downstream side of the secondary combustion chamber 17, heat is recovered by a superheater (not shown) or the like installed on a flue. Flue gas 62, which has passed through the boiler portion 18, passes through a reaction dust collector, a catalytic reaction device, and the like, which are provided on the rear stage, and is discharged to the atmosphere through a chimney.

Next, the pyrolysis gas passage 3, which connects the fluidized bed gasification furnace 2 with the vertical cyclone melting furnace 15, will be described in detail.

As described above, the pyrolysis gas 52 is introduced into the vertical cyclone melting furnace 15 through the pyrolysis gas passage 3. Specifically, the pyrolysis gas outlet 23 of the fluidized bed gasification furnace 2 and the pyrolysis gas ducts 21 of the vertical cyclone melting furnace 15 are connected to each other through the pyrolysis gas passage 3. The pyrolysis gas passage 3 is branched into two passages at a predetermined position from the upstream side (the fluidized bed gasification furnace 2) toward the downstream side (the vertical cyclone melting furnace 15), and the two branched pyrolysis gas passages 3 are connected to the pair of pyrolysis gas ducts 21, respectively.

Further, the two branched pneumatic transport pipes 31*a* are connected to the two branched pyrolysis gas passages 3 as described above. Accordingly, the pulverized incombustibles 59 are introduced into the vertical cyclone melting furnace 15 together with the pyrolysis gas 52.

Next, the function of the gasification melting facility 1 of the embodiment will be described.

The waste 51, which is put in from the waste inlet 6, is fed to the fluidized bed gasification furnace 2 through the waste discharge device 6*a* in a fixed amount and then is thermally decomposed and gasified. Accordingly, the waste 51 is decomposed into gas, tar, and char (carbide). Tar is a component that is liquid at room temperature, but is present in the form of gas in the gasification furnace. Char is gradually and finely powdered in a fluidized bed, and is introduced into the melting apparatus 4 as the pyrolysis gas 52 together with gas and tar.

In addition, a fluid medium is classified from the incombustibles and the fluid medium 53, which are discharged from the incombustible outlet 7 of the fluidized bed gasification furnace 2, by the sand classifier 9, iron is separated by the magnetic separator 10, and aluminum is separated by the aluminum sorter 11. After that, the incombustibles 57, which are put in the hopper 12, are cut out by the fixed amount feeding device 13 and are introduced into the powdering machine 14.

When the pulverized incombustibles 59, which are pulverized by the powdering machine 14 to have a particle size of 0.1 mm or less, are introduced into the pneumatic transport pipe 31 from the introduction portion 34, the pulverized incombustibles 59 are conveyed toward the downstream side together with airflow. After that, the pulverized incombustibles 59 reach the curved portion 35, and are conveyed upward along the curved portion 35 as shown by an arrow 59*a*. In this case, materials having a high specific gravity, such as metals, to be mixed in the pulverized incombustibles 59 fall without being conveyed together with airflow, and fall along the metal removal pipe 33 as shown by an arrow 59*b*. Accordingly, metals are removed from the pulverized incombustibles 59, and only the pulverized incombustibles 59 from which metals have been removed are introduced into the pyrolysis gas passage 3.

After being mixed with the pyrolysis gas 52 fed from the fluidized bed gasification furnace 2, the pulverized incombustibles 59 introduced into the pyrolysis gas passage 3 pass through the premix burners 22, are fed to the vertical cyclone melting furnace 15, and are converted into molten slag.

According to the embodiment, the pulverized incombustibles 59 are conveyed together with airflow and metals contained in the pulverized incombustibles 59 are separated while being conveyed together with airflow. Accordingly, for example, a device that removes metal such as a vibrating screen does not need to be provided, so that it is possible to construct a gasification melting facility at lower cost.

Further, since the pyrolysis gas 52 and the pulverized incombustibles 59 pass through the premix burners 22 and are fed to the vertical cyclone melting furnace, it is possible to sufficiently preheat the pyrolysis gas 52 and the pulverized incombustibles 59. Furthermore, since the particle size of the pulverized incombustibles 59 is adjusted to 0.1 mm or less, smooth melting can be performed.

Moreover, since the pyrolysis gas 52 and the pulverized incombustibles 59 are introduced from the two pyrolysis gas ducts 21, a swirling force of a gas flow in the vertical cyclone melting furnace 15 can be increased. Further, it is possible to prevent the pulverized incombustibles 59 from carrying over in the flue gas without being caught in the vertical cyclone melting furnace 15 by the throttling structure of the flue gas outlet 19 of the vertical cyclone melting furnace 15.

In addition, the scope of the invention is not limited by the above-mentioned embodiment, and the invention may have various modifications without departing from the gist of the invention. For example, the number of the branches of the pyrolysis gas passage and the number of the pyrolysis gas ducts are not limited to two, and may be three or more.

REFERENCE SIGNS LIST

1: gasification melting facility
2: fluidized bed gasification furnace
3: pyrolysis gas passage
9: sand classifier (classifier)
10: magnetic separator (separator)
11: aluminum sorter (separator)
13: fixed amount feeding device (fixed amount feeder)
14: powdering machine (pulverizer)
15: vertical cyclone melting furnace
19: flue gas outlet (throttling structure)
21: pyrolysis gas duct
22: premix burner
30: airflow conveyor (airflow transporter)
31: pneumatic transport pipe
32: blower
33: metal removal pipe
51: waste
52: pyrolysis gas
59: pulverized incombustibles

The invention claimed is:

1. A gasification melting facility comprising:

a fluidized bed gasification furnace that generates pyrolysis gas by thermally decomposing waste and discharges incombustibles;

a vertical cyclone melting furnace that includes a pyrolysis gas duct through which the pyrolysis gas is introduced;

a pyrolysis gas passage that connects the fluidized bed gasification furnace with the pyrolysis gas duct of the vertical cyclone melting furnace;

a pulverizer that pulverizes the incombustibles, which are discharged from the fluidized bed gasification furnace, into pulverized incombustibles so that the particle size of the incombustibles becomes fine;

an airflow transporter that conveys the pulverized incombustibles, which are generated by the pulverizer, together with airflow, puts the pulverized incombustibles in the pyrolysis gas passage, and separates metal contained in the pulverized incombustibles by a difference in specific gravity while conveying the pulverized incombustibles together with airflow;

a classifier that classifies the incombustibles and a fluid medium that is discharged from the fluidized bed gasification furnace on a front stage of the pulverizer;

a separator that separates iron and aluminum from the incombustibles that are classified by the classifier on the front stage of the pulverizer; and a fixed amount feeder that feeds the incombustibles, which have been subjected to the separation performed by the separator, to the pulverizer by a fixed amount on the front stage of the pulverizer, wherein the airflow transporter comprises:

a pneumatic transport pipe that connects to the pyrolysis gas passage, the pneumatic transport pipe having an introduction portion into which the pulverized incombustibles containing the metal from the pulverizer are directly introduced, the introduction portion being directly connected to the pulverizer;

a blower that generates airflow in the pneumatic transport pipe; and a metal removal pipe that extends downward from the pneumatic transport pipe, wherein the pneumatic transport pipe comprises a curved portion that is curved toward the downstream side in the airflow transporter, wherein the curved portion is bifurcated into a pulverized incombustibles transport pipe extending upward from the curved portion and the metal removal pipe extending downward from the curved portion toward the downstream side in the airflow transporter, wherein only the pulverized incombustibles from which the metals have been removed are conveyed upward along the pulverized incombustibles transport pipe by the airflow into the pyrolysis gas passage and mixed with the pyrolysis gas in the pyrolysis gas passage, and the mixed pulverized incombustibles and the pyrolysis gas are fed to the vertical cyclone melting furnace, and wherein the pyrolysis gas and the pulverized incombustibles are melted in the vertical cyclone melting furnace.

2. The gasification melting facility according to claim 1, wherein the particle size of the pulverized incombustibles is adjusted to a fine particle size of 0.1 mm or less.

3. The gasification melting facility according to claim 1, wherein the pyrolysis gas duct is provided with a premix burner.

4. The gasification melting facility according to claim 3, wherein a plurality of the pyrolysis gas passages and a plurality of the pyrolysis gas ducts are provided, and the pyrolysis gas and the pulverized incombustibles are blown into the vertical cyclone melting furnace to cause a swirling flow.

* * * * *